United States Patent [19]

O'Loughlin

[11] Patent Number: 4,550,275

[45] Date of Patent: Oct. 29, 1985

[54] HIGH EFFICIENCY PULSE ULTRAVIOLET LIGHT SOURCE

[75] Inventor: James P. O'Loughlin, Albuquerque, N. Mex.

[73] Assignee: The United States of America as represented by the Secretary of the Air Force, Washington, D.C.

[21] Appl. No.: 539,889

[22] Filed: Oct. 7, 1983

[51] Int. Cl.[4] ..... H05B 41/19

[52] U.S. Cl. ..... 315/241 R; 315/51; 315/52; 315/173; 315/240

[58] Field of Search ..... 315/241 R, 240, 173, 315/52, 51

[56] References Cited

U.S. PATENT DOCUMENTS

| | | | |
|---|---|---|---|
| 3,007,030 | 10/1961 | Ducati | 219/121 |
| 3,453,490 | 7/1969 | Hallock et al. | 315/170 |
| 3,560,795 | 2/1971 | Pollack et al. | 315/240 |
| 3,624,445 | 11/1971 | Cadwallader | 315/241 R |
| 4,054,846 | 10/1977 | Smith et al. | 331/94.5 G |
| 4,309,617 | 1/1982 | Long | 250/504 H |
| 4,339,691 | 7/1982 | Morimiya et al. | 315/111.21 |
| 4,346,420 | 8/1982 | Turchi | 361/4 |

*Primary Examiner*—Arthur Kellogg

*Attorney, Agent, or Firm*—Donald J. Singer; Bobby D. Scearce

[57] ABSTRACT

A high efficiency pulsed ultraviolet light source is provided which comprises a flashlamp containing a noble gas, for example xenon, at low pressure, and having a pair of electrodes between which a discharge through the gas may be impressed, and an electrical pulse forming circuit connected to the flashlamp comprising a lamp resistance and high voltage source connected in series with the lamp, and a capacitor and switch connected in parallel to the lamp, the capacitor and resistance selected to minimize the total inductance of the circuit and to maximize the voltage stress on the gas contained within the lamp.

6 Claims, 4 Drawing Figures

HIGH EFFICIENCY PULSE ULTRAVIOLET LIGHT SOURCE

RIGHTS OF THE GOVERNMENT

The invention described herein may be manufactured and used by or for the Government of the United States for all governmental purposes without the payment of any royalty.

BACKGROUND OF THE INVENTION

This invention relates generally to pulsed light sources, and more particularly to an improved high intensity ultraviolet light source for the efficient initiation of pulsed lasers.

The efficient initiation of pulsed lasers, and particularly pulsed chemical lasers such as the HF/DF type, requires an intense ultraviolet light source (about 285 nm), a fast rise time (about 0.5 microsecond), and a pulse width of about one microsecond. Conventional noble gas flashlamps, such as those containing xenon, are operated in a mode dominated by thermal ionization, and have been found to be of marginal utility in meeting the criteria for highly efficient operation since this type of lamp functions substantially as a black body radiator and must be raised to an effective plasma temperature of about 13,000° K. or higher for maximum radiation efficiency. Specifically, for a xenon lamp, a temperature of about 13,365° K. provides a maximum radiation efficiency of about 26.18% through a fused quartz enclosure in the 250 to 400 nm wavelength range. Conventional modes of operation for these lamps, however, typically require several microseconds to achieve an effective temperature of 10,000° K. or higher, the limitation being the rate at which energy can be loaded into the lamp.

The present invention describes an ultraviolet light source and associated circuitry wherein a flashlamp (xenon) is operated in two different modes in achieving the desired temperature in the desirably short time. Specifically, the lamp is initially operated in a streamer mode during the turn-on period for the lamp both for the purpose of generating ultraviolet light and for speeding up the rate at which the bulk temperature of the lamp rises to the level required for the conventional thermal mode of operation. According to the present invention, sufficiently high electric fields are impressed upon the lamp containing a noble gas at low pressure so that both thermal and electric field stress contribute to the ionization, and the lamp will turn on (i.e., raise to sufficiently high effective temperature) much more rapidly. Further, substantial enhancement of ultraviolet radiation centered at about 300 nm occurs when the lamp is driven with electric fields of the order of about 150 Townsends.

It is therefore an object of the present invention to provide a high efficiency pulsed ultraviolet light source.

It is a further object to provide a pulsed ultraviolet light source for the efficient initiation of pulsed lasers.

It is a further object to provide a pulsed ultraviolet light source having rapid rise time and pulse width of one microsecond or less.

These and other objects of the present invention will become apparent as the detailed description of certain representative embodiments thereof proceeds.

SUMMARY OF THE INVENTION

In accordance with the foregoing principles and objects of the present invention, a high efficiency pulsed ultraviolet light source is provided which comprises a flashlamp containing a noble gas, for example xenon, at low pressure, and having a pair of electrodes between which a discharge through the gas may be impressed, and an electrical pulse forming circuit connected to the flashlamp comprising a lamp resistance and high voltage source connected in series with the lamp, and a capacitor and switch connected in parallel to the lamp, the capacitor and resistance selected to minimize the total inductance of the circuit and to maximize the voltage stress on the gas contained within the lamp.

DESCRIPTION OF THE DRAWINGS

The present invention will be more clearly understood from the following detailed description of specific representative embodiments thereof read in conjunction with the accompanying drawings wherein.

DETAILED DESCRIPTION

Figure 1:
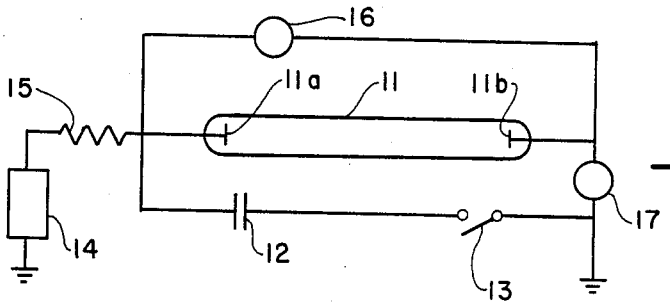
FIG. 1 is a schematic of a light source including a flashlamp and associated circuitry according to the invention.

The resistivity of a xenon lamp is quite low in the desired operating pressure and temperature ranges. The maximum voltage to which the pulse forming network is initially charged may be of the order of about twice the voltage of that delivered to the lamp at operating temperature (i.e., greater than about 10,000° K.). An electric field E of the order of 100 volts per centimeter corresponding to about 5.6 Townsends to about twice this amount, 11.2 Townsends, is normally required as a maximum stress when the electric field E is initially applied to the cold gas in the lamp. As the gas heats up, the electric field stress drops to much lower levels. Such low stress eliminates any possibility of electric field ionization and, therefore, under these conditions the turn-on time process of the lamp will be undesirably long (viz. several microseconds) as entirely controlled by the development of thermal ionization.

To increase the rate at which the temperature of the lamp is raised to the desired operating level requires that the gas contained in the lamp accept energy at a faster rate. Therefore, sufficient voltage must be applied to establish electric field ionization in addition to the thermal ionization.

The light source of the present invention solves the problem of providing efficient intense pulsed ultraviolet radiation on a microsecond time scale. To accomplish this, first, a driver (pulse forming circuit) is provided having a characteristic impedance closely matching that of the lamp over a major portion of the pulse in order to provide efficient operation of the lamp; second, the lamp is operated at low pressure; and third, the pulse-forming network or capacitor voltage is impressed at very high levels (i.e. to produce a high initial electric field E) while maintaining a low characteristic impedance in the circuit to ensure efficient overall energy transfer without damaging the lamp. The noble gas flashlamp of the invention (xenon in the examples given) is therefore characterized by two separate modes of operation over the life of the pulse. In the initial stage of operation of the flashlamp, a high electric field is applied which starts and maintains streamers in the discharge (streamer mode). Streamers are tiny finger-like filaments of extremely hot plasma which are generated by application of an electric field of sufficient strength at the proper time. The streamer mode can be achieved while the average effective bulk gas temperature within the flashlamp is low. The streamers perform two functions; first, they generate ultraviolet light while the bulk temperature within the lamp is rising, and, second, they extend throughout the bulk gas volume within the flashlamp and infuse energy to the gas which raises the bulk temperature much more rapidly than the ohmic heating method which characterizes conventional flashlamp operation. When the effective temperature reaches the desired level (above about 10,000° K.) the streamer mode is suppressed by reducing the electric field, and the lamp then functions in the thermal mode.

Referring now to FIG. 1 of the drawings, a representative embodiment of the invention herein is shown schematically. The light source of the invention including lamp and associated circuitry comprised a flashlamp 11, an energy storage capacitor 12, a pulse switch 13 and voltage source 14. Capacitor 12 and pulse switch 13 was provided in the circuit of FIG. 1 in parallel to lamp 11 as shown schematically. Resistor 15 was provided in series between voltage source 14 and the remainder of the circuit for the purpose of isolating the d.c. voltage source 14 from the flashlamp 11. Lamp 11 included electrodes 11*a*, 11*b* between which a noble gas (xenon in the examples given) was maintained at low pressure. For efficient operation of lamp 11 according to the present invention, it was found that a gas pressure of from about 25 Torr to about 75 Torr was most desirable. The total circuit inductance for the circuit shown was maintained at less than about 120 nanohenries to closely match the circuit impedance with that of lamp 11, and so that the voltage stress applied to flashlamp 11 was of sufficient magnitude (up to about 150 townsends) to stress the xenon gas into the streamer formation mode in the initial stage of the pulse formation. To accomplish this, resistor 15 was desirably from about 10,000 to about 100,000 ohms, and capacitor 12 was about 0.2 to about 0.6 microfarad for an impressed voltage 14 of from about 12,000 to about 20,000 volts (producing an electric stress of from about 90 to about 150 Townsends within lamp 11). For example, when the capacitance of capacitor 12 was selected at 0.2 microfarad and charged to 12,000 volts by high voltage source 14 through a resistor 15 of 50,000 ohms, the dual mode streamer-thermal operation was observed within flashlamp 11.

The black body equilibrium condition between current density, resistivity and temperature which characterizes normal lamp operation no longer exists under the high imposed field stresses just described as contemplated for operation of lamp 11 according to the present invention. Of the total power input to the plasma, only about 10–20 percent is accounted for by black body radiation; the rest is taken by the ionization of the gas, the excitation of meta stable states, the raising of the bulk temperature, and other losses. Lamps of 4, 5 and 7 mm diameter bore at fill pressures of about 50 Torr were tested. The 7 mm lamp produced a peak at about 250 nm whereas the 4 and 5 mm lamps peaked at about 300 nm. In any event, the spectral peak was very desirable in frequency, intensity and time envelope for the efficient initiation of HF/DF chemical laser reactions.

Figure 1A:
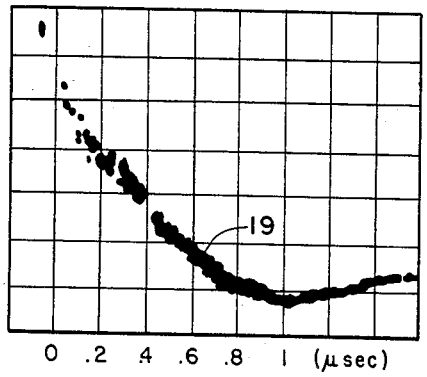
FIG. 1*a* is a voltage trace for the circuit of FIG. 1.
Figure 1B:
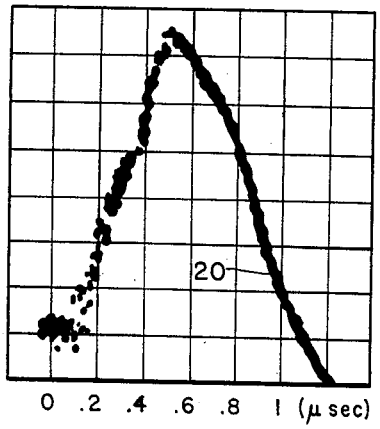
FIG. 1*b* is a current trace for the circuit of FIG. 1.

FIGS. 1*a* and 1*b* present typical voltage and current traces, respectively, for the circuit presented in FIG. 1. Lamp pressure was 50 Torr under an applied electric field of 150 Townsend. The voltage trace 19 of FIG. 1*a* was that which was measured by a voltage probe 16; the trace 19 was taken at 0.2 microsecond/division along the abscissa and about 2 kV/division along the ordinate. The current trace 20 as shown in FIG. 1*b* is that which was measured by current probe 17 in the circuit of FIG. 1. Current trace 20 was taken at 0.2 microsecond/division by about 800 amps/division. The streamer mode of operation for lamp 11 in the earliest stage of operation thereof is exemplified by the irregular behavior of the current and voltage during the time period represented in the respective traces 19,20 in the range of from about 0 to 0.5 microsecond.

Figure 2:
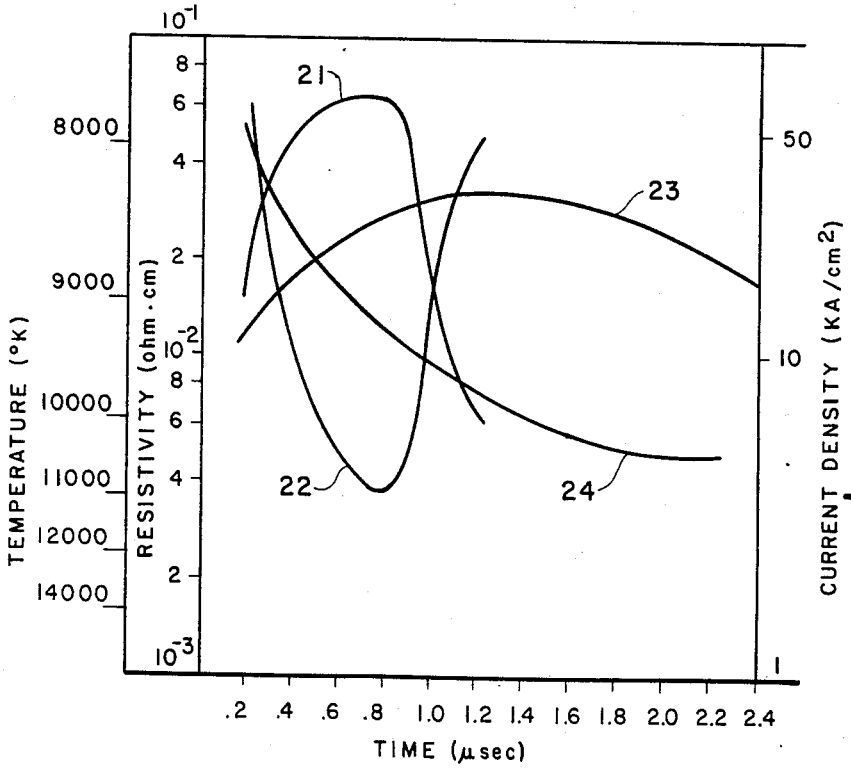
FIG. 2 presents the characteristic traces for two different flashlamps, one operated according to the present invention and the other operated conventionally.

Referring now to FIG. 2, presented therein are the traces for current density and resistivity and corresponding temperature for two different xenon flashlamps, one operated in the dual mode fashion of the present invention, and the other lamp operated only in the conventional thermal mode. Curve 21 and curve 22 present, respectively, plots of the current density and resistivity and equivalent temperature as a function of time for the lamp 11 of FIG. 1 using a capacitor 12 of 0.4 microfarad and operated at 14,000 volts. The attainment of the desirable pulse width of about one microsecond is evident. Specifically, a temperature of about 11,000° K. is attained in about 0.8 microsecond. Further, the amount of energy required is of the order of one-half to one-third the amount required by lamps using conventional ohmic heating. For comparative purposes, curve 23 and curve 24, respectively, present plots of current density and resistivity and corresponding temperature for a flashlamp operating only in the conventional thermal mode. This lamp requires two microseconds to achieve an effective temperature of about 10,500° K.

The present invention, as hereinabove described, therefore provides an improved pulsed light source, particularly suited for efficient initiation of pulsed lasers, and characterized by a fast rise time and a pulse width of the order of one microsecond. It is understood that certain modifications to the invention may be made, as might occur to one with skill in the field of this invention, within the scope of the appended claims. Therefore, all embodiments contemplated hereunder have not been shown in complete detail. Other embodiments may be developed without departing from the spirit of the invention or from the scope of the appended claims.

I claim:

1. A high intensity pulsed ultraviolet light source comprising:

a. a low pressure noble gas filled flashlamp having a pair of electrodes for supporting a discharge therebetween through said gas;

b. a low impedance pulse forming circuit connected to said flashlamp, said circuit including a series connected switch and capacitor operatively connected to said electrodes;

c. a high voltage source and lamp resistance operatively connected to one of said electrodes for imposing a high electric field within said gas between said electrodes prior to said discharge.

2. The light source as recited in claim 1 wherein said gas comprises xenon.

3. The light source as recited in claim 2 wherein the pressure of said gas within said lamp prior to discharge is from about 25 to 75 Torr.

4. The light source as recited in claim 3 wherein the impedance of said circuit is less than about 120 nanohenries.

5. The light source as recited in claim 1 wherein the impedance of said pulse forming network closely matches that of said flashlamp.

6. The light source as recited in claim 3 wherein the electric field strength imposed upon said gas prior to discharge is in the range of from about 90 to about 150 Townsends.

* * * * *